US008626007B2

(12) United States Patent
Suda

(10) Patent No.: US 8,626,007 B2
(45) Date of Patent: Jan. 7, 2014

(54) HEATING DEVICE HAVING HIGH DEGREE OF FREEDOM IN DESIGN, AND IMAGE FORMING APPARATUS

(75) Inventor: Takeyuki Suda, Toride (JP)

(73) Assignee: Canon Kabushiki Kaisha (JP)

( * ) Notice: Subject to any disclaimer, the term of this patent is extended or adjusted under 35 U.S.C. 154(b) by 223 days.

(21) Appl. No.: 13/271,274

(22) Filed: Oct. 12, 2011

(65) Prior Publication Data

US 2012/0087681 A1 Apr. 12, 2012

(30) Foreign Application Priority Data

Oct. 12, 2010 (JP) ..... 2010-229569

(51) Int. Cl.
*G03G 15/20* (2006.01)

(52) U.S. Cl.
USPC ..... 399/33; 399/329

(58) Field of Classification Search
USPC ..... 399/33, 329; 219/636, 619, 216, 219/469–471
See application file for complete search history.

(56) References Cited

U.S. PATENT DOCUMENTS 6,959,158 B2 * 10/2005 Ohta ..... 219/619
2005/0173416 A1 8/2005 Fukushi et al.
2008/0002996 A1 * 1/2008 Ushiro ..... 399/33
2011/0274449 A1 * 11/2011 Mine ..... 399/33
2012/0085744 A1 * 4/2012 Suda ..... 219/216
2012/0148287 A1 * 6/2012 Samei et al. ..... 399/329

FOREIGN PATENT DOCUMENTS

CN 101109924 A 1/2008
JP 2001-267050 A 9/2001
JP 2007-328159 A 12/2007

OTHER PUBLICATIONS

Notification of the First Office Action for corresponding CN 201110302264.9, dated Oct. 10, 2013. English translation provided.

* cited by examiner

*Primary Examiner* — Susan Lee
(74) *Attorney, Agent, or Firm* — Rossi, Kimms & McDowell LLP

(57) ABSTRACT

A heating device and an image forming apparatus which make it possible to improve the degree of freedom in design to enhance the accuracy of detecting the state of a to-be-heated member, and easily reduce cost. An induction heating coil generates magnetic flux by flow of electric current therethrough. Ferrite cores formed of a magnetic material form magnetic paths. The fixing belt generates heat by the action of the magnetic flux generated by the induction heating coil 101. An antenna is disposed in an area at a location opposite to the fixing belt 120 with the ferrite cores therebetween, for detecting magnetic flux passing through the area. A control circuit determines whether or not the state of the fixing belt has changed, based on a result of detection by the antenna.

5 Claims, 9 Drawing Sheets

HEATING DEVICE HAVING HIGH DEGREE OF FREEDOM IN DESIGN, AND IMAGE FORMING APPARATUS

BACKGROUND OF THE INVENTION

1. Field of the Invention

The present invention relates to a heating device for heating a member to be heated, by electromagnetic induction, and an image forming apparatus.

2. Description of the Related Art

Conventionally, there has been known a heating device for heating a member to be heated (hereinafter referred to as "to-be-heated member") by electromagnetic induction. For example, in an image forming apparatus, such as a copying machine or a printer, such a heating device heats a metal roller or a metal belt, which is a to-be-heated member, by electromagnetic induction, and fixes a toner image formed on a sheet using the heat of the heated to-be-heated member.

There has also been known an image forming apparatus of this type, which detects a change in the state of a metal belt as the to-be-heated member, such as a damage, as disclosed in Japanese Patent Laid-Open Publication No. 2007-328159.

FIG. 9 schematically shows a fixing device as a heating device for the image forming apparatus disclosed in Japanese Patent Laid-Open Publication No. 2007-328159. The fixing device has an inlet upper roller 6 and an exit upper roller 7 arranged on upstream and downstream sides, respectively, in a manner spaced from each other. A fixing belt 2, which is an endless metal belt, is wound and stretched between the inlet and exit upper rollers 6 and 7. A nip pad 8 for applying pressure to a sheet, and a temperature-detecting thermistor 4 are arranged inside the fixing belt 2. An inlet lower roller 10 and an exit lower roller 11 are arranged on the upstream and downstream sides, respectively, in a manner spaced from each other, and an endless pressing belt 9 is wound and stretched between the inlet and exit lower rollers 10 and 11. A nip pad 12 is disposed inside the pressing belt 9. An antenna 3 for detecting magnetic flux is disposed inside the fixing belt 2 at a location opposite to an induction heating coil 1 with the fixing belt 2 positioned therebetween. The antenna 3 is connected to an energization inhibition circuit, not shown.

The magnetic flux entering the antenna 3 varies depending on the state of the fixing belt 2, and therefore, the image forming apparatus is configured to detect the state of the fixing belt 2 according to the magnetic flux entering the antenna 3 and make the energization inhibition circuit operable to stop the operation of the induction heating coil 1 if there is abnormality in the state of the fixing belt 2.

However, in the image forming apparatus disclosed in Japanese Patent Laid-Open Publication No. 2007-328159, the nip pad 8 and the temperature-detecting thermistor 4 are arranged inside the fixing belt 2, and hence there are limitations to the shape and material of the antenna 3. Further, the inside of the fixing belt 2 is under a high-temperature environment, and hence it is necessary to use heat-resistant members which are high in cost, for the antenna 3, which reduces the degree of freedom in design.

Further, normally, to prevent members other than the fixing belt 2 which is the to-be-heated member, particularly members that are not desired to be heated, from generating heat by induction heating, the image forming apparatus is provided with magnetic shields. However, the magnetic shields sometimes adversely affect the antenna 3, causing reduced voltage output from the antenna 3, which sometimes makes it difficult to detect a small magnetic flux.

SUMMARY OF THE INVENTION

The present invention provides a heating device and an image forming apparatus which make it possible to improve the degree of freedom in design to enhance the accuracy of detecting the state of a to-be-heated member, and easily reduce cost.

In a first aspect of the present invention, there is provided a heating device comprising a coil that generates magnetic flux by flow of electric current therethrough, a core formed of a magnetic material, for forming a magnetic path, a to-be-heated member configured to generate heat by action of the magnetic flux generated by the coil, a magnetic flux-detecting unit disposed in an area opposite to the to-be-heated member with the core positioned therebetween, for detecting magnetic flux passing through the area, and a control unit configured to determine whether or not a state of the to-be-heated member has changed, based on a result of detection by the magnetic flux-detecting unit.

In a second aspect of the present invention, there is provided an image forming apparatus comprising a transfer unit configured to transfer a toner image onto a recording medium, a coil that generates magnetic flux by flow of electric current therethrough, a core formed of a magnetic material, for forming a magnetic path, a fixing belt configured to generate heat by action of the magnetic flux generated by the coil, and thereby heat the toner image transferred onto the recording medium, a magnetic flux-detecting unit disposed in an area opposite to the fixing belt with the core positioned therebetween, for detecting magnetic flux passing through the area, and a control unit configured to determine whether or not a state of the fixing belt has changed, based on a result of detection by the magnetic flux-detecting unit.

According to the present invention, it is possible to improve the degree of freedom in design to enhance the accuracy of detecting the state of a to-be-heated member, and easily reduce cost.

The features and advantages of the invention will become more apparent from the following detailed description taken in conjunction with the accompanying drawings.

DESCRIPTION OF THE EMBODIMENTS

The present invention will now be described in detail below with reference to the accompanying drawings showing embodiments thereof.

Figure 1:
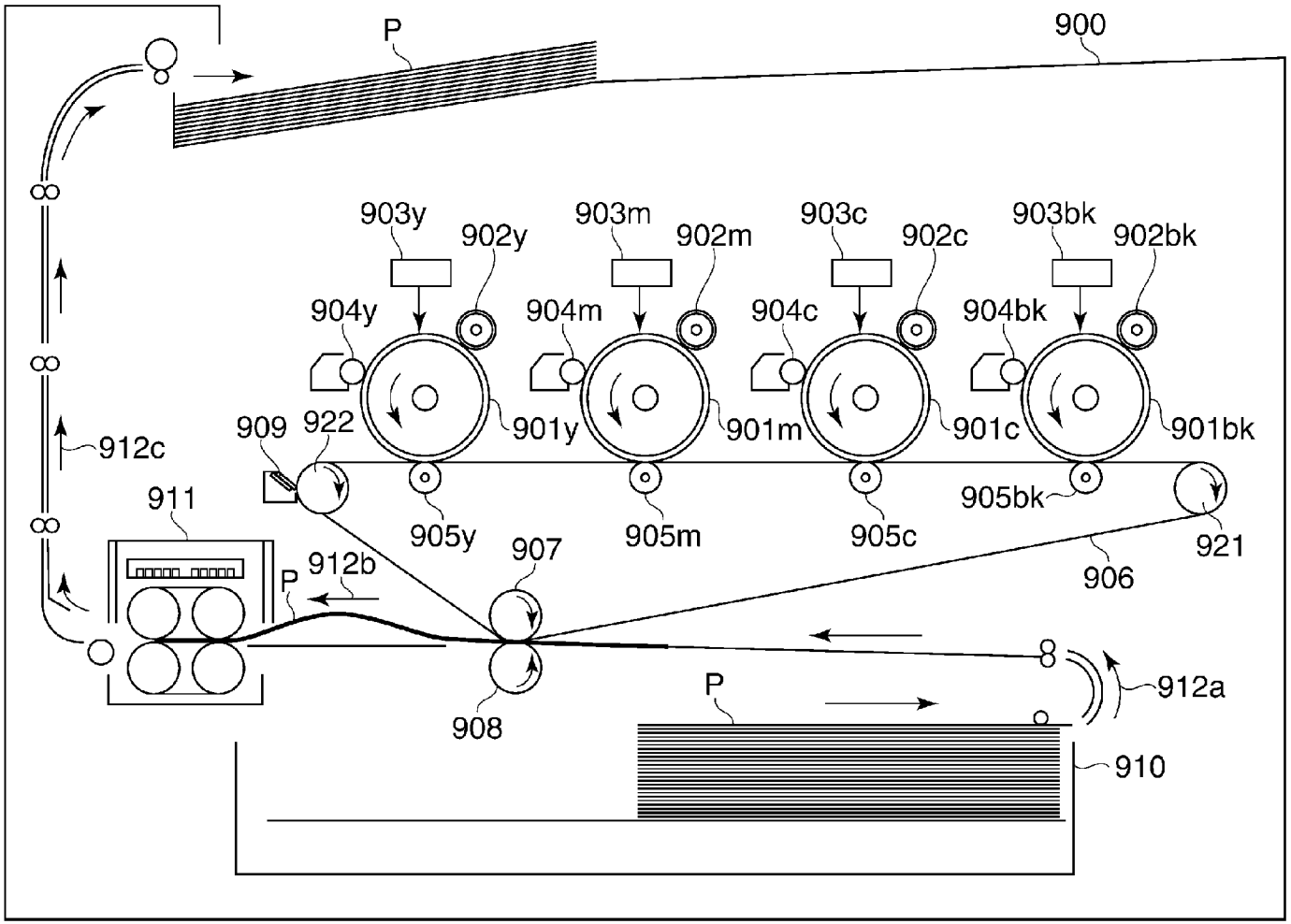
FIG. 1 is a schematic diagram of the whole arrangement of an image forming apparatus to which is applied a heating device according to an embodiment of the present invention.

FIG. 1 is a diagram of a whole image forming apparatus to which is applied a heating device according to an embodiment of the present invention. The image forming apparatus, denoted by reference numeral 900, is configured as an electrophotographic full-color printer including a fixing unit 911 as a heating device, by way of example.

The image forming apparatus 900 includes image forming units of four colors, arranged in a tandem manner from left to right, as viewed in FIG. 1. The image forming units are each an electrophotographic processing mechanism based on a laser exposure method, and have the same configuration. Component elements associated with yellow, magenta, cyan, and black are denoted by symbols "y", "m", "c", and "bk", respectively.

Now, a description will be given of a yellow image forming unit. In the image forming apparatus 900, a charging roller 902*y* charges a photosensitive drum 901*y* to a predetermined potential, to thereby smooth the potential of the photosensitive drum 901*y*. The photosensitive drum 901*y* rotates counterclockwise, as viewed in FIG. 1, and a laser unit 903*y* scans the surface of the photosensitive drum 901*y* by laser beam, and forms an electrostatic latent image on the surface thereof.

Further, an intermediate transfer belt 906 is wound and stretched between a driving roller 921, a driven roller 922, and a secondary transfer roller 907, and is driven for clockwise rotation, as viewed in FIG. 1. A primary transfer charging roller 905*y* is disposed on the reverse side of the intermediate transfer belt 906. According to the electrostatic latent image formed on the surface of the photosensitive drum 901*y*, toner is attached to the photosensitive drum 901*y* by a development blade 904*y*. At this time, the toner image attached to the photosensitive drum 901*y* matches an image drawn as the electrostatic latent image. After the photosensitive drum 901*y* further rotates, the toner image is transferred onto the intermediate transfer belt 906. The other image forming units each have the same arrangement as the yellow image forming unit, and hence descriptions thereof are omitted.

The four-color toner image attached to the intermediate transfer belt 906 is transferred onto a sheet P, which is a recording medium conveyed from a sheet cassette 910 via a sheet conveying path 912*a*, by the secondary transfer roller 907 and a secondary-transfer opposed roller 908. Toner remaining on the intermediate transfer belt 906 without being transferred onto the sheet P is removed by a cleaning unit 909.

The sheet P having the toner image attached thereto is conveyed to the fixing unit 911 via a sheet conveying path 912*b*, and the toner image, which is unfixed, is fixed on the sheet P by heat and pressure. The sheet P having the toner image fixed thereon is discharged via a sheet conveying path 912*c* as a product.

Figure 2:
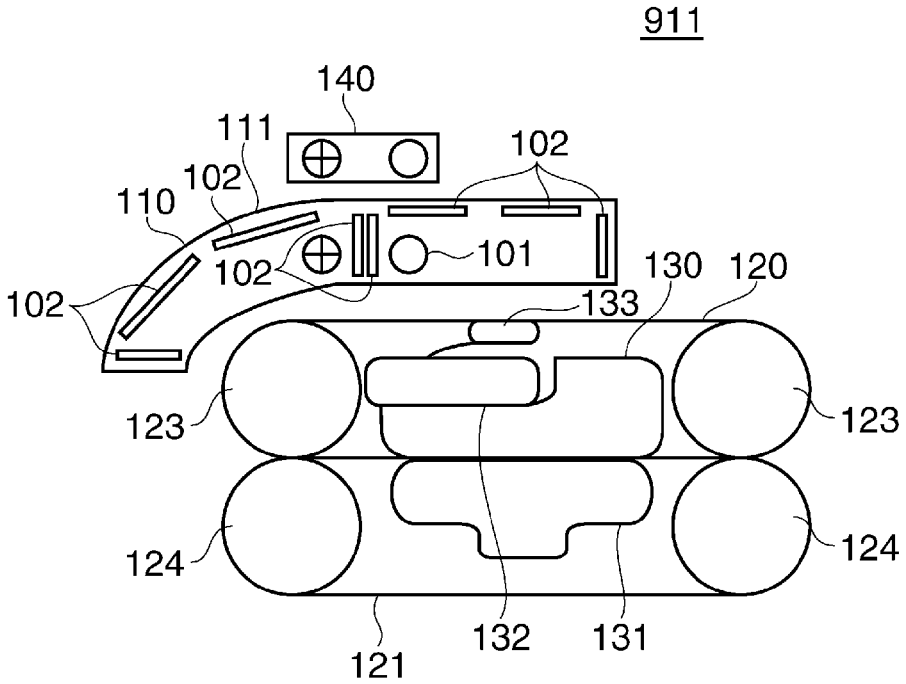
FIG. 2 is a schematic diagram of a fixing unit.

Next, a description will be given of the arrangement of the fixing unit 911. FIG. 2 schematically shows the fixing unit 911. The left side, as viewed in FIG. 2, is the downstream side of a flow of the sheet P.

In the fixing unit 911, an upper fixing belt 120, which is an endless to-be-heated member, is wound and stretched between two core metals 123 such that the fixing belt 120 is rotated by rotations of the core metals 123. The fixing belt 120 is made of metal, and is heated by a so-called electromagnetic induction heating method, in which heat is generated by an eddy current caused to flow by the action of an alternating magnetic flux generated by an induction heating coil 101. More specifically, the fixing belt 120 has a rubber layer formed on the front side of a conductive layer made of metal, and heat is generated by the eddy current flowing through the conductive layer. A material which has a high relative permeability and hence is highly permeable to magnetic flux is selected for the conductive layer of the fixing belt 120.

Further, a lower fixing belt 121, which is an endless pressing belt, is wound and stretched between two core metals 124 such that the fixing belt 121 is rotated by rotations of the core metals 124. The sheet P having the unfixed toner image attached thereto passes between the two fixing belts 120 and 121, whereby the unfixed toner image is fixed.

Nip pads 130 and 131, which are metal plates for applying pressure to the sheet P, are arranged inside the upper and lower fixing belts 120 and 121, respectively, whereby spaces inside the upper and lower fixing belts 120 and 121 are narrowed. Further, a thermistor 133 is disposed inside the upper fixing belt 120, and the wiring of the thermistor 133 is shielded by a magnetic shield 132 in a simplified fashion. The temperature of the fixing belt 120 is measured by the thermistor 133.

A heating coil unit 110 is disposed close to an upper portion of the fixing belt 120. The heating coil unit 110 comprises the induction heating coil 101, ferrite cores 102, which are magnetic bodies, and a casing 111 for supporting the whole heating coil unit 110. The induction heating coil 101 is designed such that magnetic flux generated by the same passes through magnetic paths mainly formed by the ferrite cores 102 and the fixing belt 120.

A loop antenna 140 as a magnetic flux-detecting unit (hereinafter simply referred to as the "antenna 140") is disposed close to an upper portion (outer portion) of the heating coil unit 110. More specifically, the antenna 140 is disposed in an area at a location opposite to the fixing belt 120 with the ferrite cores 102 positioned therebetween, and detects magnetic flux passing through the area. The position of the antenna 140 is also an area at a location opposite to the fixing belt 120 with the induction heating coil 101 positioned therebetween. The antenna 140 is configured to generate voltage or current by magnetic flux, and in the present embodiment, detects magnetic flux using an output voltage. The basic arrangement of the antenna 140 is the same as the antenna disclosed in Japanese Patent Laid-Open Publication No. 2007-328159. The antenna 140 extends in the direction of width of the fixing belt 120 (direction of depth as viewed in FIG. 2), and is disposed such that an electric wire reciprocates in the extending direction of the antenna 140 to form a generally annular shape (form a loop) longer in the extending direction.

Figure 3:
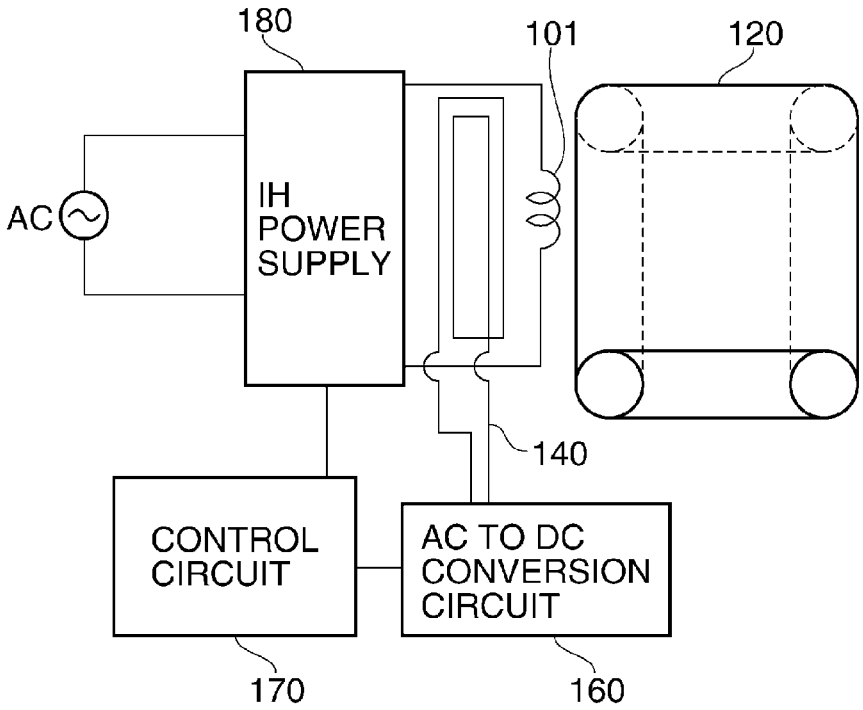
FIG. 3 is a block diagram of a control mechanism of the fixing unit.

FIG. 3 is a block diagram of a control mechanism of the fixing unit 911. An output voltage from the antenna 140 is delivered to a control circuit (control unit) 170 via an AC to DC conversion circuit 160. The control circuit 170 controls the operation of an IH (induction heating) power supply 180 such that it can start and stop the IH power supply 180. The IH power supply 180 is controlled as above to thereby drivingly control the induction heating coil 101. The control circuit 170 comprises a CPU, not shown, an ASIC (application-specific integrated circuit), not shown, and so forth, and controls the overall operation of the fixing unit 911.

Figure 4:
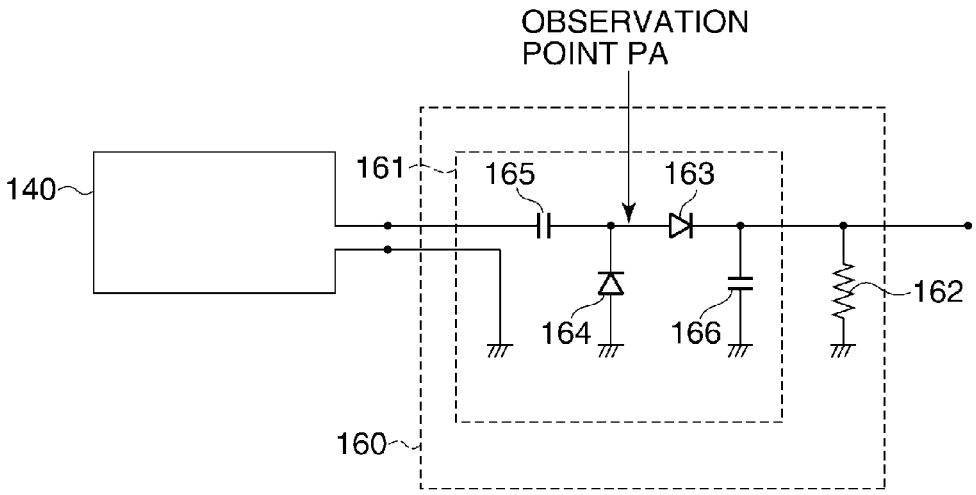
FIG. 4 is a circuit diagram of an AC to DC conversion circuit.

FIG. 4 is a circuit diagram of the AC to DC conversion circuit 160. An output from the AC to DC conversion circuit 160 is proportional to the output voltage from the antenna 140, and hence based on the output from the AC to DC conversion circuit 160, it is possible to know the level of voltage generated by the antenna 140. The waveform of the voltage generated by the antenna 140 is similar to a waveform of the differentiation of magnetic flux entering the antenna 140, and the magnetic flux entering the antenna 140 is generated by electric current flowing through the induction heating coil 101. Therefore, the basic frequency of the waveform of the voltage generated by the antenna 140 is the same as the basic frequency of an AC current flowing through the induction heating coil 101, and is approximately 20 KHz to 80 KHz.

Figure 5A:
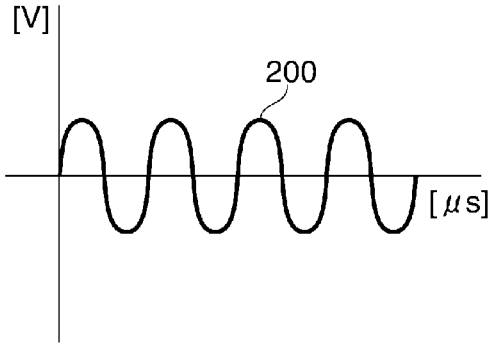
FIGS. 5A to 5C are views showing a waveform of an output from an antenna, a waveform of an output from the AC to DC conversion circuit, and a DC waveform, respectively.
Figure 5B:
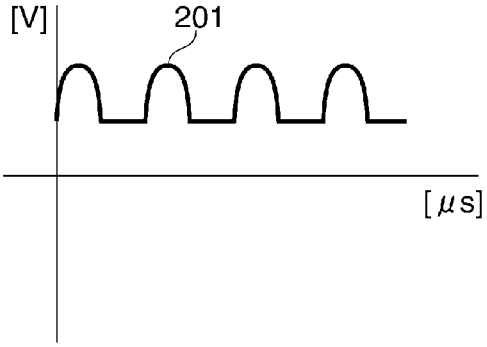
Figure 5C:
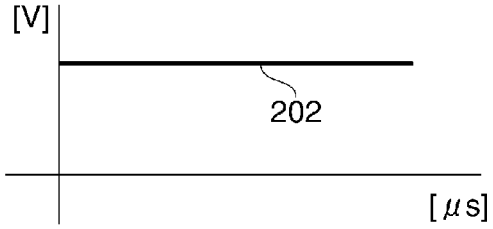

FIGS. 5A to 5C show the waveform of an output from the antenna 140, a waveform of the output from the AC to DC conversion circuit 160, and a DC waveform, respectively. Hereinafter, the operation and waveform of the AC to DC conversion circuit 160 will be described with reference to FIG. 4 and FIGS. 5A to 5C.

The AC to DC conversion circuit 160 converts a high-frequency AC voltage 200 generated by the antenna 140 (FIG. 5A) to a DC voltage 202 (FIG. 5C), for outputting the same. To this end, in the present embodiment, there is employed a voltage doubler rectifier circuit 161 which includes diodes 163 and 164, and capacitors 165 and 166 (FIG. 4).

At an observation point PA of the voltage doubler rectifier circuit 161 shown in FIG. 4, a waveform 201 (FIG. 5B) is observed, and the output signal has a DC voltage 202 (FIG. 5C). Further, the voltage doubler rectifier circuit 161 can be provided with a resistance 162 for adjusting discharge current, so as to change the drop rate of the DC voltage 202, as desired. As described above, it is possible to know the level of voltage output from the antenna 140 based on an output signal from the AC to DC conversion circuit 160.

Figure 6A:
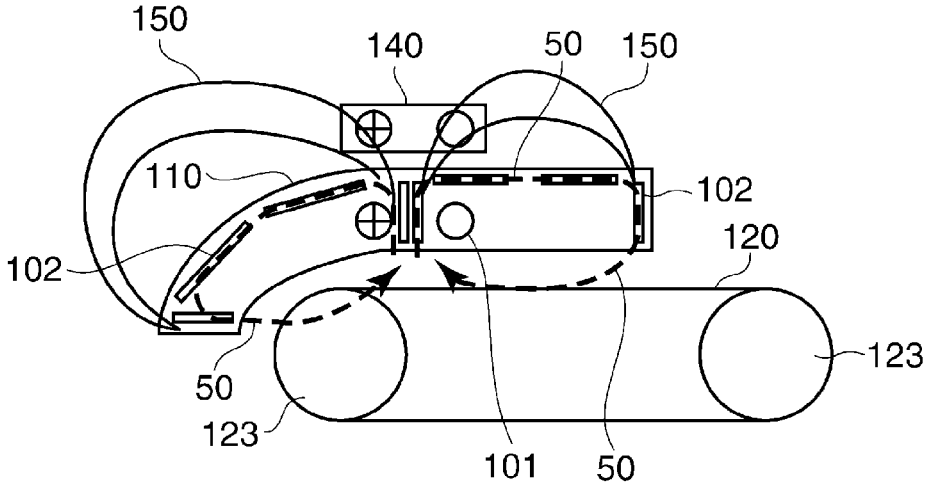
FIGS. 6A and 6B are views showing magnetic paths formed when the fixing belt is normal and when the same is abnormal, respectively.
Figure 6B:
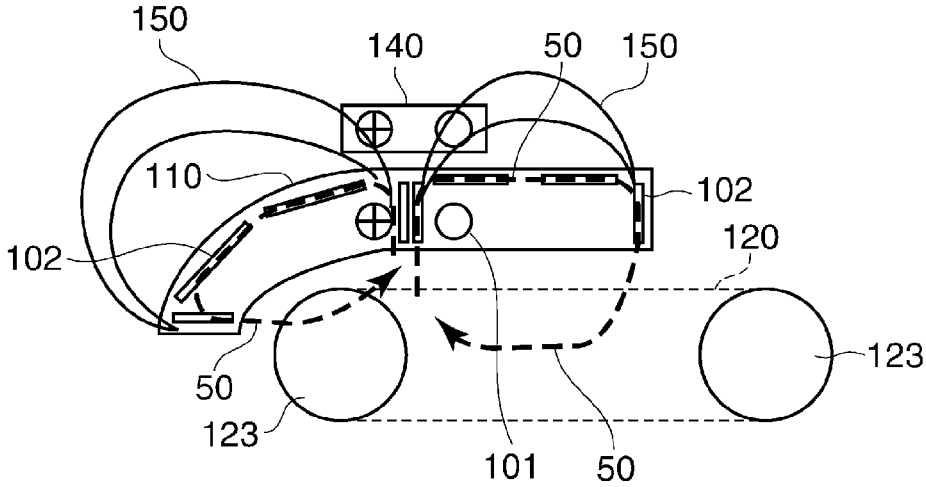

FIGS. 6A and 6B show magnetic paths formed when the fixing belt 120 is normal and when the same is abnormal, respectively. Now, the phrase "when the fixing belt 120 is abnormal" is intended to mean "when the state of the fixing belt 120 has changed from a normal state thereof". The phrase is intended to mean, for example, "when the fixing belt 120 suffers from damage (belt abnormality), such as breakage and peeling. In FIGS. 6A and 6B, component parts inside the fixing belt 121 and the fixing belt 120 are omitted from illustration.

As shown in FIG. 6A, when the fixing belt 120 is normal, much of magnetic flux generated by the induction heating coil 101 flows to pass through magnetic paths formed by the ferrite cores 102 and the fixing belt 120. Magnetic flux flowing through the ferrite cores 102 is referred to as "the magnetic flux 50".

In the fixing belt 120, when an eddy current flows, Joule heat is generated to thereby generate heat, and at the same time magnetic flux is generated by the eddy current in a direction of canceling magnetic flux generated by the induction heating coil 101, whereby a magnetomotive force is generated in a direction opposite to a direction of a magnetomotive force generated by the induction heating coil 101. At this time, magnetic flux 150 which does not pass through the ferrite cores 102 exists around the heating coil unit 110, and a ratio of the amount (density) of the magnetic flux 150 which does not pass through the ferrite cores 102 to the amount of the magnetic flux 50 passing through the ferrite cores 102 is held constant.

Therefore, if the amount of the magnetic flux 150 which does not through the ferrite cores 102 is detected by the antenna 140 disposed at a location around the heating coil unit 110, it is possible to estimate the amount of the magnetic flux 50 passing through the ferrite cores 102.

In a case where the fixing belt 120 is broken for some reason (FIG. 6B), the magnetic flux which was generated by the eddy current flowing through the fixing belt 120 and flowed in the direction opposite to the direction of the magnetic flux generated by the induction heating coil 101 is no longer generated. Therefore, the magnetomotive force which was generated in the direction opposite to the direction of the magnetomotive force generated by the induction heating coil 101 is no longer generated either.

At this time, the fixing belt 120 having a higher magnetic permeability than that in the air does is substantially lost at a damaged portion thereof, and hence the magnetic resistance of the whole magnetic circuit increases. However, the effects of disappearance of the magnetomotive force generated by the eddy current are dominant, which increases the total amount of the magnetic flux. For this reason, when the fixing belt 120 is damaged, the amount of the magnetic flux 50 passing through the ferrite cores 102 increases to thereby also increase the amount of the magnetic flux 150 passing through the antenna 140, whereby the level of the output voltage from the antenna 140 becomes higher (FIG. 6B). Therefore, when the fixing belt 120 is damaged, the value of the output signal from the AC to DC conversion circuit 160 becomes larger than when the fixing belt 120 is normal.

Next, a description will be given of a method in which the control circuit 170 determines whether or not the state of the fixing belt 120 has changed, based on the results of detection by the antenna 140 (process for determining abnormality of the fixing belt).

Figure 7A:
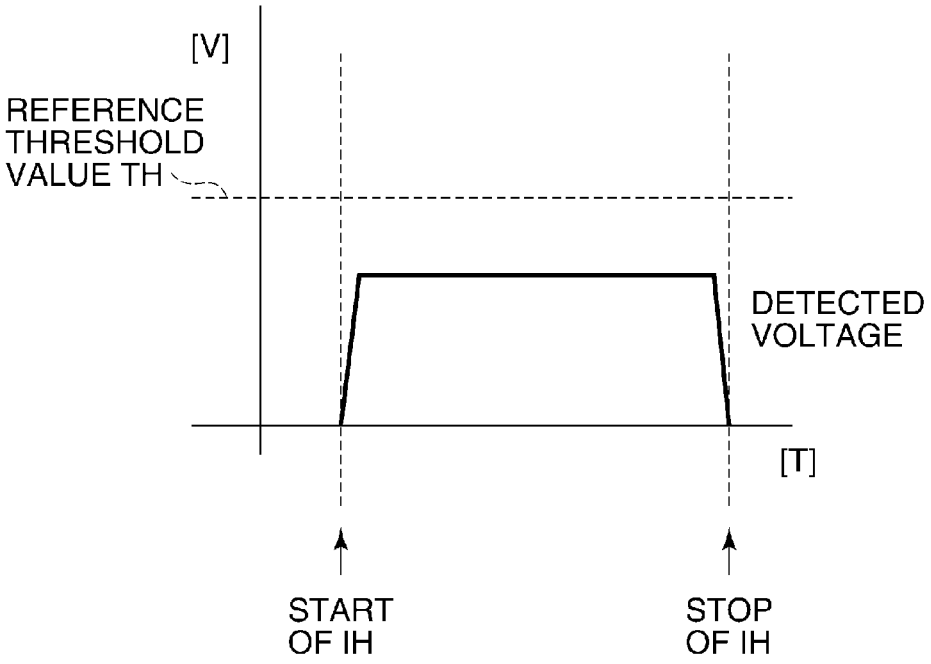
FIGS. 7A and 7B are views showing waveforms of outputs from the AC to DC conversion circuit exhibited when the fixing belt is normal and when the same is abnormal, respectively.
Figure 7B:
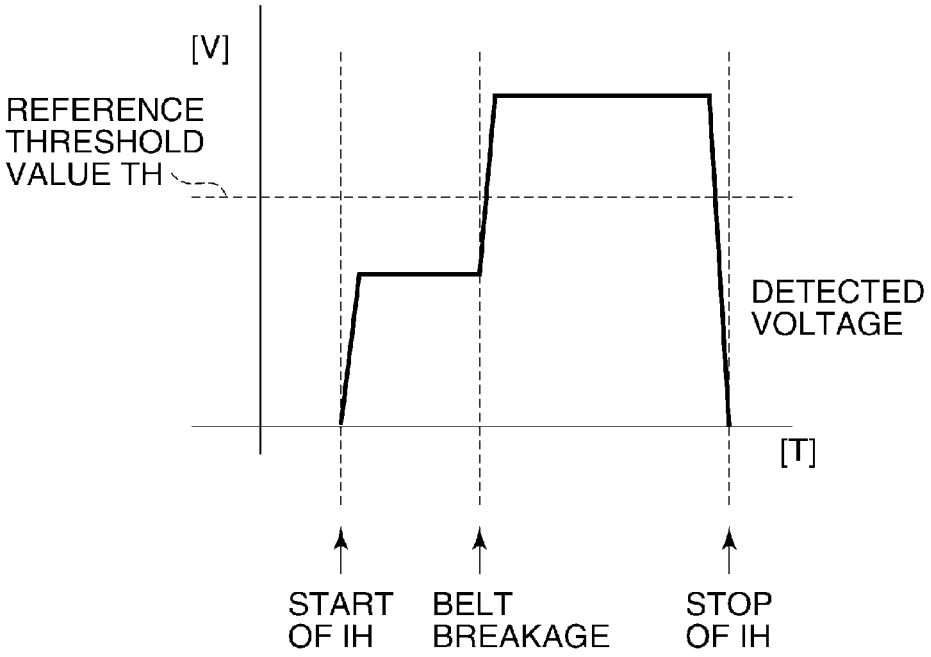

FIGS. 7A and 7B show waveforms of the output from the AC to DC conversion circuit 160 when the fixing belt 120 is normal and when the same is abnormal, respectively.

As shown in FIG.7A, when induction heating is started at a certain time point (IH start), the output from the AC to DC conversion circuit 160 (detected voltage) rises and then is held almost constant. The value of the output does not exceed a reference threshold value TH until the induction heating is stopped.

Next, when some abnormality occurs in the fixing belt 120 during operation of the induction heating, causing breakage of part of the fixing belt 120, the output from the AC to DC conversion circuit 160 suddenly rises after a time point when the part of the fixing belt 120 has been broken, to exceed the reference threshold value TH. This state continues until the induction heating is stopped.

Therefore, the control circuit 170 can determine whether or not the state of the fixing belt 120 has changed, by monitoring the output from the AC to DC conversion circuit 160 and comparing the output with the reference threshold value TH. In this case, it is possible to determine that the fixing belt 120 suffers from belt abnormality when the output from the AC to DC conversion circuit 160 has exceeded the reference threshold value TH.

Figure 8:
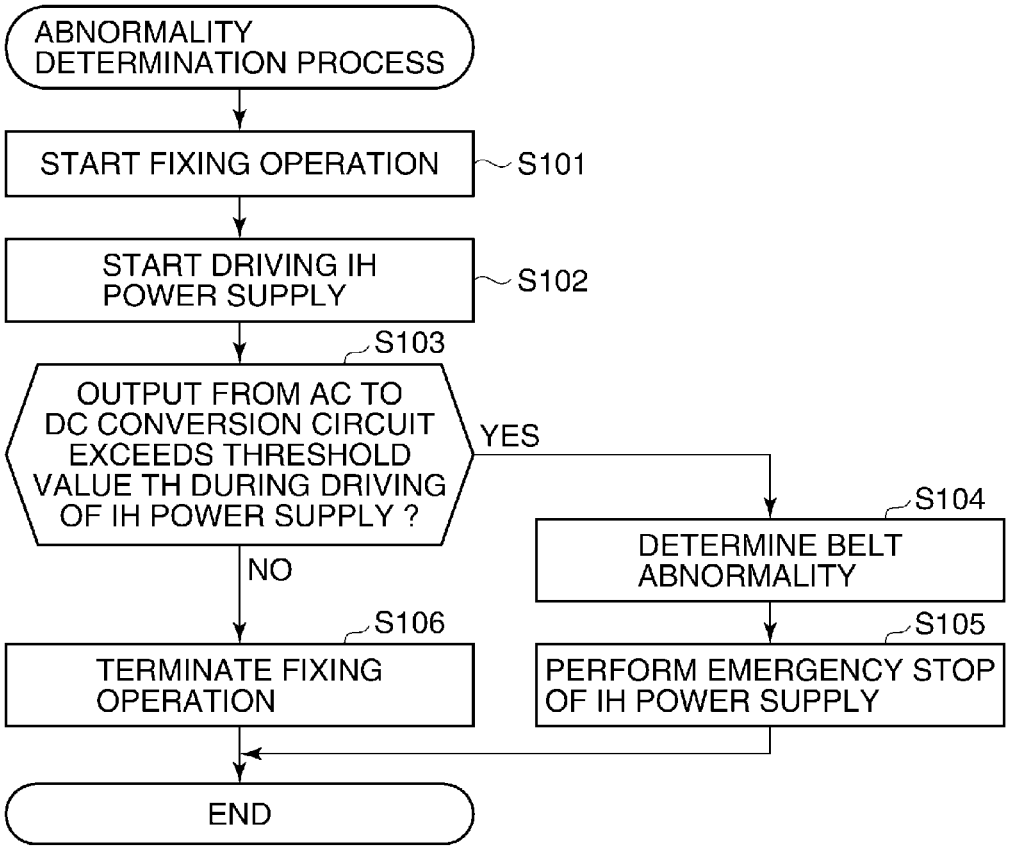
FIG. 8 is a flowchart of an abnormality determination process for determining abnormality of the fixing belt.
Figure 9:
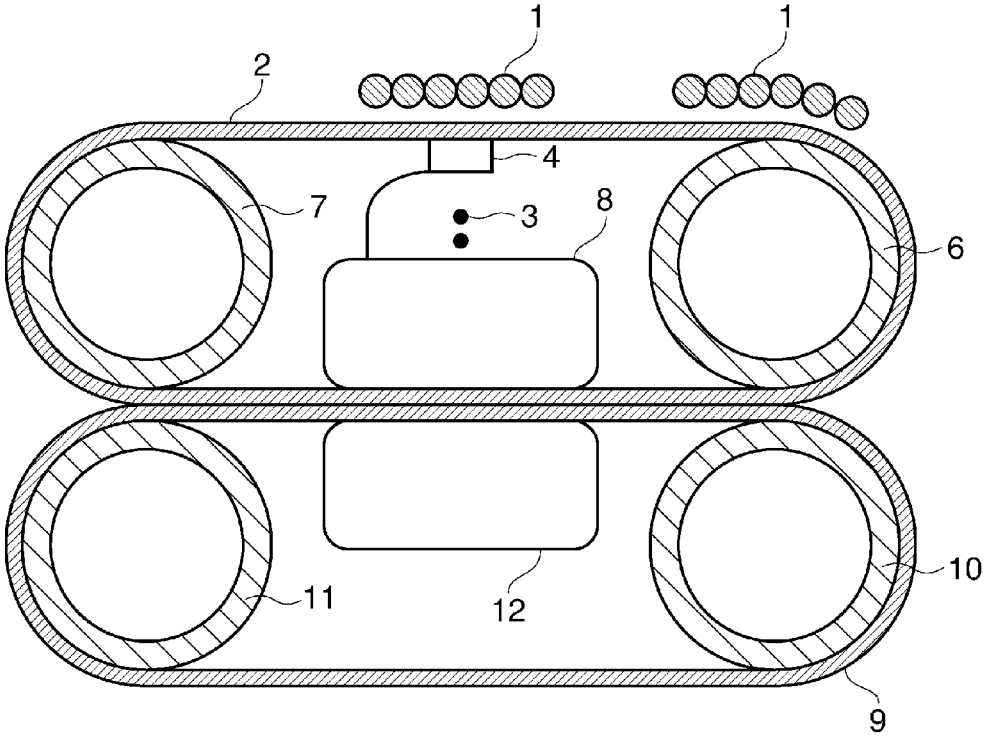
FIG. 9 PRIOR ART
FIG. 9 is a schematic diagram of a fixing device for an image forming apparatus disclosed in Japanese Patent Laid-Open Publication No. 2007-328159.

FIG. 8 is a flowchart of a process for determining abnormality of the fixing belt 120.

When the image forming apparatus 900 starts a print job, the control circuit 170 causes the fixing unit 911 to start a fixing operation (step S101). Next, the control circuit 170 starts driving the IH power supply 180 to thereby cause an AC current to flow through the induction heating coil 101 (step S102). More specifically, to raise the temperature of the fixing belt 120 to a temperature required for printing (e.g. 200° C. ), the control circuit 170 performs induction heating during the print job.

Then, the control circuit 170 determines whether or not the output from the AC to DC conversion circuit 160 has exceeded the reference threshold value TH during driving of the IH power supply 180 (step S103). More specifically, the control circuit 170 continues to monitor the output from the AC to DC conversion circuit 160 while the IH power supply 180 is in operation for the fixing operation of the fixing unit 911. Then, the control circuit 170 determines whether or not the output from the AC to DC conversion circuit 160 has exceeded the reference threshold value TH, before the induction heating for the fixing operation becomes unnecessary and the driving of the IH power supply 180 is stopped.

As a result of the determination, if the output from the AC to DC conversion circuit 160 has exceeded the reference threshold value TH during the driving of the IH power supply 180, the control circuit 170 determines that the belt abnormality has occurred (step S104). In this case, the control circuit 170 performs emergency stop of driving of the IH power supply 180 to thereby stop supply of electric power to the induction heating coil 101 (step S105). The emergency stop of the IH power supply 180 makes it possible to prevent the fixing operation from being continued in an abnormal state. As a result, it is possible to improve safety by preventing occurrence of a further failure.

On the other hand, in the step S103, if the driving of the IH power supply 180 has been terminated without the output from the AC to DC conversion circuit 160 exceeding the reference threshold value TH, the control circuit 170 terminates the fixing operation (step S106). In this case, occurrence of the belt abnormality is not detected.

According to the present embodiment, the antenna 140 is disposed in the area at a location opposite to the fixing belt 120 with the ferrite cores 102 positioned therebetween. This area where the antenna 140 is disposed is not in a narrow space inside the fixing belt 120 but in a wide space outside the fixing belt 120, so that in configuring the antenna 140 such that a sufficient detection signal can be obtained, limitations to the shape and material of the antenna 140 are reduced. Further, the above-described area for disposing the antenna 140 is not under a high-temperature environment, differently from the inside of the fixing belt 120, and hence it is not necessary to use an expensive, highly heat-resistant member for the antenna 140. Moreover, the antenna 140 disposed outside the fixing belt 120 is not adversely affected by the magnetic shield 132 (FIG. 2), and hence it is easy to secure high output from the antenna 140 and easy to detect a small magnetic flux. This makes it possible to improve the degree of freedom in design, enhance the accuracy of detecting the state of the fixing belt 120, and easily reduce cost.

Further, when the belt abnormality occurs, the driving of the IH power supply 180 is forcibly stopped. This makes it possible to avoid wasteful processing and improve safety.

The area for disposing the antenna 140 is by no means limited to the above-described example. That is, it is only required to dispose the antenna 140 in such an area as makes it possible to detect magnetic flux leaking from magnetic paths formed to extend through the ferrite cores 102 and the fixing belt 120. Therefore, it is possible to dispose the antenna 140 at a desired location around the heating coil unit 110, opposite to the fixing belt 120 with the ferrite cores 102 and the heating coil unit 110 positioned therebetween. This also leads to the enhanced degree of freedom in design of the heating device.

Further, the construction of the "magnetic flux-detecting unit" for detecting magnetic flux is not limited to the antenna 140, but the magnetic flux-detecting unit may be constructed using a hall element or the like.

Further, the "to-be-heated member" as a target of which a change in state is to be determined is not limited to the fixing belt of a belt fixing type fixing device. For example, the to-be-heated member may be a fixing roller of a roller fixing type fixing device or a supporting member for supporting solid ink, in an ink jet printer. In this case, it is envisaged that a change in the state of the fixing roller or the supporting member corresponds to deformation, such as damage or distortion, of the fixing roller or the supporting member.

Although in the above-described embodiment, the present invention is applied to the fixing device for the image forming apparatus, this is not limitative, but the present invention can be applied to any device insofar as it is a heating device in which a to-be-heated member generates heat by electromagnetic induction. For example, the present invention can be applied to a heating device for a laminating process for forming a layered member by affixing thin layers of materials to each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2010-229569 filed Oct. 12, 2010, which is hereby incorporated by reference herein in its entirety.

What is claimed is:

1. A heating device comprising:

a coil that generates magnetic flux by flow of electric current therethrough;

a core formed of a magnetic material, for forming a magnetic path;

a to-be-heated member configured to generate heat by action of the magnetic flux generated by said coil;

a magnetic flux-detecting unit disposed in an area opposite to said to-be-heated member with said core positioned therebetween, for detecting magnetic flux passing through the area; and a control unit configured to determine whether or not a state of said to-be-heated member has changed, based on a result of detection by said magnetic flux-detecting unit.

2. The heating device according to claim 1, wherein said control unit determines that the state of said to-be-heated member has changed in a case that the result of detection by said magnetic flux-detecting unit exceeds a reference threshold value.

3. The heating device according to claim 1, wherein said control unit stops supply of electric power to said coil in a case that said control unit determines that the state of said to-be-heated member has changed.

4. The heating device according to claim 1, wherein said magnetic flux-detecting unit is formed by an antenna that generates voltage or current by the magnetic flux.

5. An image forming apparatus comprising:

a transfer unit configured to transfer a toner image onto a recording medium;

a coil that generates magnetic flux by flow of electric current therethrough;

a core formed of a magnetic material, for forming a magnetic path;

a fixing belt configured to generate heat by action of the magnetic flux generated by said coil, and thereby heat the toner image transferred onto the recording medium;

a magnetic flux-detecting unit disposed in an area opposite to said fixing belt with said core positioned therebetween, for detecting magnetic flux passing through the area; and a control unit configured to determine whether or not a state of said fixing belt has changed, based on a result of detection by said magnetic flux-detecting unit.

* * * * *